US010205210B2

(12) United States Patent
Yoon et al.

(10) Patent No.: US 10,205,210 B2
(45) Date of Patent: Feb. 12, 2019

(54) CAVITY FILTER INCLUDING CERAMIC RESONATOR

(71) Applicant: ACE TECHNOLOGIES CORPORATION, Incheon (KR)

(72) Inventors: Jae Kwang Yoon, Incheon (KR); Dong-Wan Chun, Incheon (KR)

(73) Assignee: ACE TECHNOLOGIES CORPORATION, Incheon (KR)

( * ) Notice: Subject to any disclaimer, the term of this patent is extended or adjusted under 35 U.S.C. 154(b) by 3 days.

(21) Appl. No.: 15/407,180

(22) Filed: Jan. 16, 2017

(65) Prior Publication Data

US 2017/0207509 A1 Jul. 20, 2017

(30) Foreign Application Priority Data

Jan. 19, 2016 (KR) ..... 10-2016-0006235

(51) Int. Cl.

| | |
|---|---|
| ***H01P 1/208*** | (2006.01) |
| ***H01P 1/205*** | (2006.01) |
| ***H01P 1/207*** | (2006.01) |
| ***H01P 7/10*** | (2006.01) |

(52) U.S. Cl.

CPC ..... *H01P 1/2084* (2013.01); *H01P 1/205* (2013.01); *H01P 1/207* (2013.01); *H01P 7/10* (2013.01)

(58) Field of Classification Search

CPC ..... H01P 1/207; H01P 1/2084; H01P 7/10

USPC ..... 333/229

See application file for complete search history.

(56) References Cited

U.S. PATENT DOCUMENTS

| | | | | |
|---|---|---|---|---|
| 4,646,038 A * | 2/1987 | Wanat | H01P 7/10 | 333/202 |
| 5,146,193 A * | 9/1992 | Sokola | H01P 1/2056 | 333/134 |
| 2007/0241843 A1* | 10/2007 | D'Ostilio | H01P 7/04 | 333/229 |

FOREIGN PATENT DOCUMENTS

| | | | |
|---|---|---|---|
| JP | 2010-098673 | A | 4/2010 |
| KR | 10-2004-0058602 | A | 7/2004 |
| KR | 10-2013-0050623 | A | 5/2013 |
| KR | 10-2015-0113448 | A | 10/2015 |

* cited by examiner

*Primary Examiner* — Benny Lee
*Assistant Examiner* — Hafizur Rahman

(57) ABSTRACT

A cavity filter having a ceramic resonator is disclosed. The disclosed cavity filter may include: a housing in which at least one cavity is formed and which has a ceramic resonator held in the cavity; a ceramic ring joined to an upper part of the ceramic resonator; and a cover joined to one side of the housing, where a through-hole is formed in the ceramic resonator to form a penetration from one side to the other side along one direction, and a metal layer is formed on a surface on the one side of the ceramic resonator, on a surface on the other side of the ceramic resonator, and on the inner perimeter of the through-hole. The disclosed cavity filter can provide the advantage that it can be manufactured as a compact structure.

15 Claims, 6 Drawing Sheets

CAVITY FILTER INCLUDING CERAMIC RESONATOR

CROSS-REFERENCE TO RELATED APPLICATIONS

This application claims the benefit of Korean Patent Application No. 10-2016-0006235, filed with the Korean Intellectual Property Office on Jan. 19, 2016, the disclosure of which is incorporated herein by reference in its entirety.

BACKGROUND

1. Technical Field

The present invention relates to a cavity filter, more particularly to a cavity filter that includes a ceramic resonator.

2. Description of the Related Art

With advances in mobile communication, there have been rapid increases in demand for RF equipment such as filters, duplexers, multiplexers, and the like. RF equipment may be used in the filtering, separation, and transfer of signals in places such as base stations, etc., in a mobile communication system.

An RF filter is a device for passing the signals of a particular frequency band. In devices that require high power, such as in the base station of a mobile communication system, a cavity filter having a cavity-based structure is mainly used.

A cavity filter, the structure of which may include multiple cavities formed within the filter with resonators installed inside the cavities, is a filter that performs the filtering by way of resonance in each of the cavities.

One of the most frequently used resonators in a cavity filter is the coaxial resonator, which is structured to have a cylindrical form with a hole or recess formed therein.

With respect to mobile communication systems, there is a demand for transmission and reception performance of higher sensitivity, as well as a demand for smaller equipment. In particular, along with the increase in number of low-output compact base stations, there is a growing demand is for smaller sizes in equipment used in such base stations. As such, there is a continuous demand for smaller sizes also in the cavity filter using coaxial resonators.

In the past, resonators of a step-impedance structure were used, in which the shape of the coaxial resonator was changed to enable a smaller size for the coaxial resonator cavity filter.

FIG. 1 conceptually illustrates a cavity filter using a resonator of a step impedance structure according to the related art.

Referring to FIG. 1, the cavity filter using a resonator of a step impedance structure may include a housing 10, a resonator 20, and a cover 30.

As can be seen in FIG. 1, a cavity filter that uses a resonator having the step impedance structure has the shape of the resonator 20 modified at its upper end from the existing cylindrical form. By thus forming a step impedance section to increase the gap capacitance between the cover 30 and the resonator 20, the resonance frequency could be lowered to enable a smaller size of the resonator 20.

However, such modification of the shape of the coaxial resonator can no longer satisfy the demands for smaller size as required in current base stations.

SUMMARY OF THE INVENTION

To resolve the problem in the related art described above, an aspect of the present invention aims to provide a cavity filter including a ceramic resonator that can be manufactured as a compact structure.

To achieve the objective above, an embodiment of the present invention provides a cavity filter that includes: a housing in which at least one cavity is formed and which has a ceramic resonator held in the cavity; a ceramic ring joined to an upper part of the ceramic resonator; and a cover joined to one side of the housing, where a through-hole is formed in the ceramic resonator to form a penetration from one side to the other side along one direction, and a metal layer is formed on a surface on the one side of the ceramic resonator, on a surface on the other side of the ceramic resonator, and on the inner perimeter of the through-hole.

The housing can have two or more cavities formed therein, and the cavity filter can further include a coupling member. The coupling member can have both ends positioned near two ceramic resonators, respectively, to generate cross-coupling between the two ceramic resonators.

The housing can include a protrusion part formed on a surface of the cavity, where the protrusion part can protrude along the one direction, and the ceramic resonator can be arranged in the cavity such that the protrusion part is inserted into the through-hole.

The inner diameter at one side of the through-hole can be larger than the inner diameter at the other side of the through-hole.

The ceramic resonator can be secured by way of a fastening part joined to the protrusion part, where the outer diameter of the fastening part can be smaller than or equal to the inner diameter at the one side of the through-hole but larger than the inner diameter at the other side of the through-hole.

The cavity filter can further include a pressing member joined to the cover, where an insertion area can be formed in the cover to receive the pressing member inserted therein. A thin-film portion that has a smaller thickness compared to the main body of the cover can be formed in the insertion area, and the pressing member can be inserted in the insertion area to press the thin-film portion. In this case, the ceramic ring can contact the thin-film portion.

Also, the cavity filter can further include a tuning bolt joined to the cover, where the tuning bolt can be inserted inside the housing through the through-hole.

The tuning bolt can be configured such that its insertion depth is adjustable and securable.

The ceramic ring can have an annular shape with a hole formed therein.

The materials of the housing and the cover can include metal.

The material of the pressing member can include an elastic material.

The material of the tuning bolt can include metal.

A cavity filter including a ceramic resonator according to an embodiment of the present invention provides the advantage that it can be manufactured as a compact structure.

Additional aspects and advantages of the present invention will be set forth in part in the description which follows, and in part will be obvious from the description, or may be learned by practice of the invention.

DETAILED DESCRIPTION OF THE INVENTION

Figure 1:
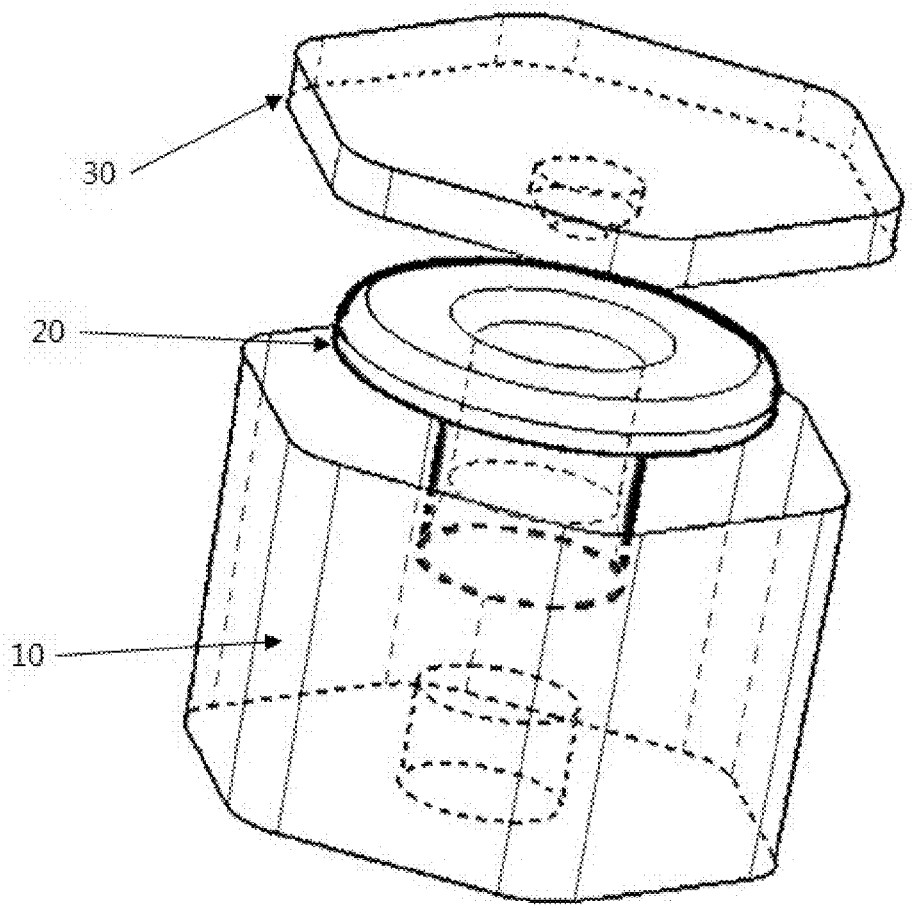
FIG. 1 conceptually illustrates a cavity filter using a resonator of a step impedance structure according to the related art.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention.

While such terms as "first" and "second," etc., may be used to describe various components, such components must not be limited to the above terms. The above terms are used only to distinguish one component from another. For example, a first component may be referred to as a second component without departing from the scope of rights of the present invention, and likewise a second component may be referred to as a first component. Certain embodiments of the invention will be described below in more detail with reference to the accompanying drawings.

Figure 2:
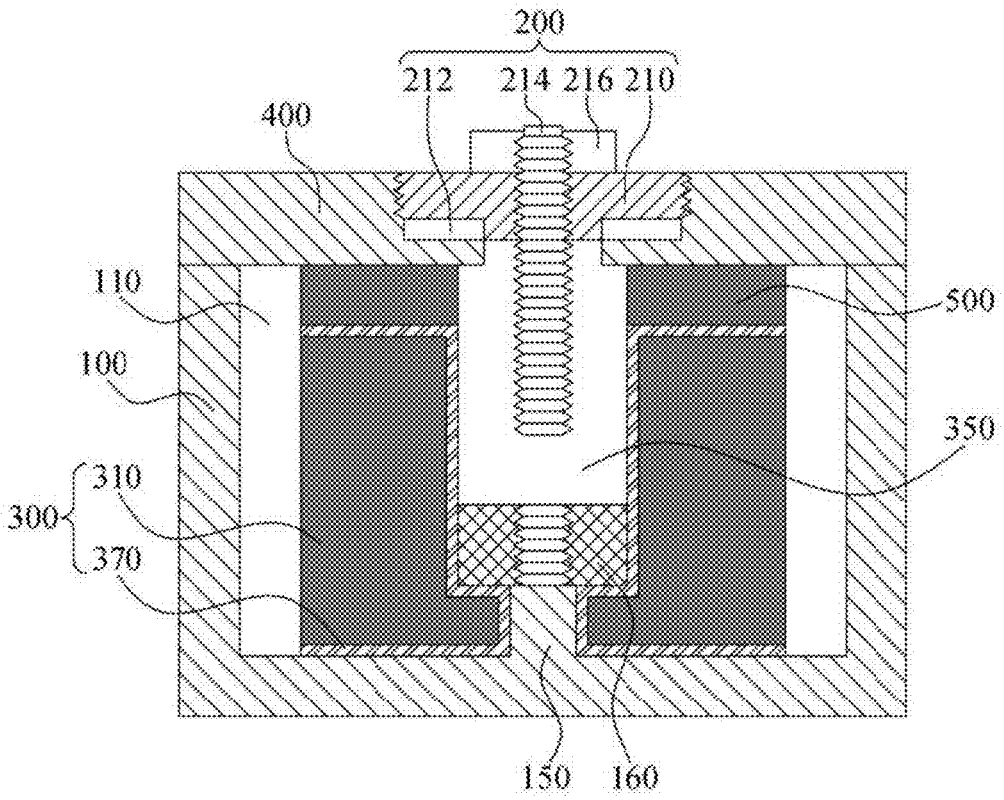
FIG. 2 is a cross-sectional view of a cavity filter according to an embodiment of the present invention.

FIG. 2 is a cross-sectional view of a cavity filter according to an embodiment of the present invention.

Referring to FIG. 2, a cavity filter according to an embodiment of the invention may include, mainly, a housing 100, a pressing member 200, a cover 400, and a ceramic resonator 300 and a ceramic ring 500 that are inserted in the cavity 110 of the housing 100.

The housing 100 may serve as the main body of the filter, and one or more cavities 110 can be formed in the housing 100. A cavity 110 may be open towards one side of the housing 100. The housing 100 can be formed from a conductive material, such as a metallic material for example.

A ceramic resonator 300 may be installed in each cavity 110. The ceramic resonator 300 may essentially be composed of a resonator body 310 and a metal layer 370, where the resonator body 310 may be made of a ceramic material and may have a through-hole 350 forming a penetration from one side to the other side in one direction. Due to the high dielectric constant of the ceramic material, the ceramic resonator 300 can be implemented in a smaller form compared to a coaxial resonator based on the related art.

The metal layer 370 may be formed on the inner perimeter of the through-hole 350 and on the surfaces on one side and the other side of the resonator body 310. Although the example in FIG. 2 shows the metal layer 370 formed over the whole of the surfaces of the one side and the other side of the resonator body 310, i.e. over the entire upper surface and the entire lower surface, it is possible to form the metal layer 370 only partially over the surfaces of the one side and the other side.

The metal layer 370 of the ceramic resonator 300 can be formed using any of a variety of methods, including metallization processes such as plating, deposition, sputtering, etc. The metal layer 370 can be formed with silver (Ag) but is not thus limited.

The metal layer 370 formed on the inner perimeter of the through-hole 350 in the ceramic resonator 300 enables resonance, and as the metal layer 370 is formed also on the surfaces on the one side and the other side of the resonator body 310, coupling with an adjacent resonator is also enabled. The ceramic resonator 300 according to an embodiment of the present invention can be implemented in a sufficiently smaller size compared to the coaxial resonator based on the related art.

Referring to FIG. 2, a protrusion part 150 can be formed in the housing 100, where the protrusion part 150 may protrude in one direction from a surface of the cavity 110. When mounting the ceramic resonator 300 in a cavity 110 of the housing 100, the protrusion part 150 can be inserted into the through-hole 350 of the ceramic resonator 300, whereby the ceramic resonator 300 can be secured in the correct position.

In order to secure the ceramic resonator 300 more firmly, a fastening part 160 can be joined onto the protrusion part 150. In one example, the through-hole 350 of the ceramic resonator 300 can be formed such that its inner diameter is larger at one side than at the other side, and the protrusion part 150 can be inserted in the through-hole 350 from the other side that is formed with a smaller inner diameter.

Here, the fastening part 160 configured to join onto the upper side of the protrusion part 150 can be inserted through the opposite, one side of the through-hole 350. By having the outer diameter of the fastening part 160 smaller than the inner diameter of the one side and larger than the inner diameter at the other side of the through-hole 350, it is possible to join the fastening part 160 with the protrusion part 150 to prevent the ceramic resonator 300 from leaving its proper position within the cavity 110.

While FIG. 2 illustrates an example in which a male thread is formed on one side of the protrusion part 150 and a corresponding female thread is formed in the fastening part 160, any of a variety of methods can be used for joining the fastening part 160 onto the protrusion part 150. Also, although an arrangement having a stepped curb is provided as an example of the through-hole 350 having different inner diameters at the one side and the other side, the invention is not limited to such arrangement.

The fastening part 160 can be made from any of a variety of materials, including not only metal but also plastic materials.

Also, if the ceramic resonators 300 are secured by a different means such as a stripper bolt, etc., then it would be possible to omit the protrusion part 150 and the fastening part 160. Also, other possible arrangements may include using the pressing member to secure the ceramic resonator 300 firmly within the cavity 110 or forming corresponding a protrusion and a slot on the inner wall of the cavity 110 and the outer perimeter of the ceramic resonator 300 and having the protrusion and the slot mate with each other to secure the ceramic resonator 300 in its correct position. Of course, various other methods can also be used for securing the ceramic resonator 300 without the protrusion part 150 and fastening part 160. If the protrusion part 150 and the fastening part 160 are omitted using any such method, then the through-hole 350 in the ceramic resonator 300 can be formed with the same inner diameter at the one side and the other side.

Referring to FIG. 2, a ceramic ring 500 may be joined to an upper part of the ceramic resonator 300. The ceramic ring 500 may have an annular shape and may have a hole formed on the inside. The hole in the ceramic ring 500 and the hole or recess formed in the ceramic resonator 300 are the area where a tuning bolt, described later in further detail, may be inserted.

The ceramic ring 500 may be used to increase capacitance between the ceramic resonator 300 and the cover 400 of the filter. The ceramic ring 500 may be fabricated from a ceramic material. Ceramic is a dielectric substance having a high dielectric constant, and due to the high dielectric constant of the ceramic ring 500, the capacitance formed between the ceramic resonator 300 and the cover 400 may be increased. The sizes of the ceramic resonator 300 and the cavity 110 may be determined by the operating frequency of the filter. The lower the operating frequency, the larger the sizes needed for the ceramic resonator 300 and the cavity 110.

As the ceramic ring 500 increases the capacitance between the ceramic resonator 300 and the cover 400 of the filter, the sizes of the ceramic resonator 300 and the cavity 110 can be reduced compared to the case having no ceramic ring 500.

The combined height of the ceramic resonator 300 and the ceramic ring 500 may correspond to the height of the inside of the housing, so that the ceramic ring 500 may contact the cover 400 of the filter.

Referring to FIG. 2, the cover 400 may be configured to join onto the open one side of the housing 100. As the cover 400 is joined to the housing 100, the ceramic resonator 300 and the ceramic ring 500 may be housed within the cavity 110. The cover 400 can be formed from a conductive material, as is the housing 100, and a material such as metal, for example, can be used. With the cover 400 joined on, the filter forms a structure that shields the inside of the filter from electromagnetic waves.

The cover 400 and the housing 100 can be joined using any of a variety of joining methods. For instance, the cover 400 can be joined to the housing 100 using multiple bolts or by using soldering.

The housing 100 and the cover 400 of the filter may have an electrically grounded potential. To achieve the desired electrical property, as well as to firmly secure the ceramic ring 500, it may be necessary to keep the ceramic ring 500 in tight contact with the cover 400, and the pressing member 200 may serve to provide the pressure needed for such tight contact.

Figure 3:
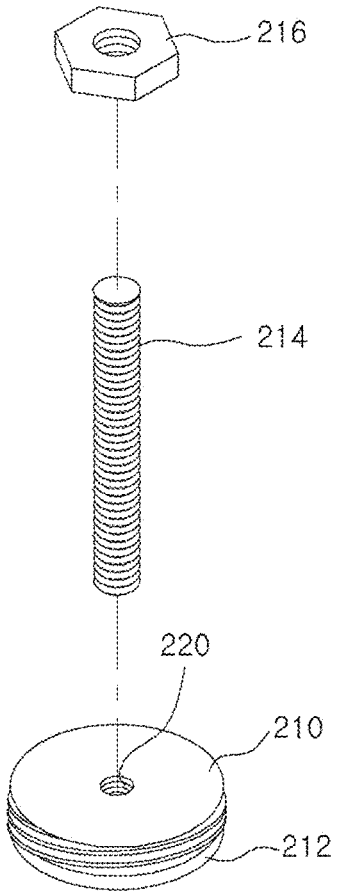
FIG. 3 is an exploded perspective view of a pressing member applied to a cavity filter according to an embodiment of the present invention.
Figure 4:
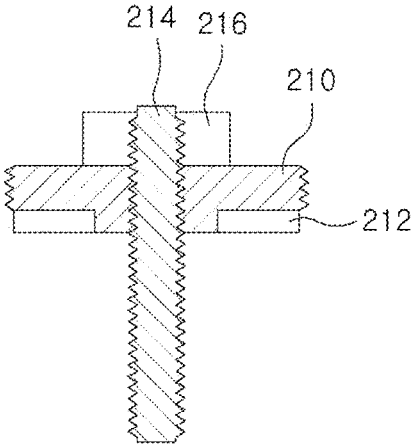
FIG. 4 is a cross-sectional view of a pressing member applied to a cavity filter according to an embodiment of the present invention.

FIG. 3 is an exploded perspective view of a pressing member applied to a cavity filter according to an embodiment of the present invention, and FIG. 4 is a cross-sectional view of a pressing member applied to a cavity filter according to an embodiment of the present invention.

Referring to FIG. 3, a pressing member 200 according to an embodiment of the invention can include an insertion part 210, an elastic member 212, and a tuning bolt 214.

The insertion part 210 may be the portion that is inserted in the insertion area of the cover 400 described later on. The insertion part 210 can have a cylindrical structure and can have a male thread formed on its outer perimeter to facilitate the insertion into the insertion area of the cover 400. The insertion part 210 may be made from a metal material.

In a center portion of the insertion part 210, an insertion hole 220 may be formed, with the tuning bolt 214 joined at the insertion hole 220. A thread may be formed in the inner perimeter of the insertion hole 220 in the insertion part 210, and a thread may be formed also in the outer perimeter of the tuning bolt 214, so that the tuning bolt may be inserted into the insertion hole 220 by way of a screw joint. The tuning bolt 214 may be rotated for insertion through the insertion hole 220, and the insertion depth can be adjusted based on the how much it is rotated.

At a lower portion of the insertion part 210, an elastic member 212 may be joined. The elastic member 212 can be joined to a lower portion of the insertion part 210 by bonding, for example, but various other joining methods can also be used.

Referring to FIG. 4, the elastic member 212 can have an annular shape, with a hole formed in the center. The elastic member 212 is an element for pressing the filter cover, and a rubber of a silicone material, for example, can be used for the elastic member 212.

Figure 5:
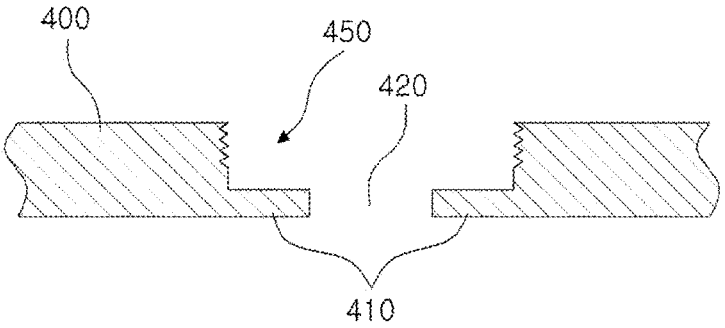
FIG. 5 is a cross-sectional view of an area where a pressing member is to be applied in a cavity filter according to an embodiment of the present invention.

FIG. 5 is a cross-sectional view of an area where a pressing member is to be applied in a cavity filter according to an embodiment of the present invention.

Referring to FIG. 5, a cover 400 according to an embodiment of the invention can include a thin-film portion 410, an insertion area 450, and a hole 420.

The cover 400 may have a rectangular shape with a particular thickness. In a particular part of the cover 400, a thin-film portion 410 may be formed which has a smaller thickness than the rest of the cover 400. By forming the thin-film portion 410 with a thickness that is smaller than the cover 400, an insertion area 450 may be formed in the cover 400 in which the pressing member 200 can be inserted.

The thin-film portion 410 may have an annular shape, and a hole 420 may be formed in a center portion of the thin-film portion 410. The thickness of the thin-film portion 410 may be selected as a value that allows deformation when pressed by the pressing member 200. The thin-film portion 410 may desirably have an annular shape, and the hole 420 may also desirably have a circular shape.

The insertion area 450, formed by the difference in thickness between the cover 400 and the thin-film portion 410, may have a thread formed in its inner perimeter.

The position of the insertion area 450 formed in the cover 400 may correspond to the position of each ceramic resonator 300. The insertion area 450 may be formed above the ceramic resonator 300, and if there are three ceramic resonators 300 installed, then the cover can have three insertion areas 450 formed therein.

The pressing member 200 may be inserted in each insertion area 450, where the number of pressing members 200 may correspond to the number of insertion areas 450. The pressing member 200 may be inserted in the insertion area 450 and may apply pressure on the cover 400 so that the cover 400 and the ceramic ring 500 joined to the upper part of the ceramic resonator may maintain contact in a stable manner.

Figure 6:
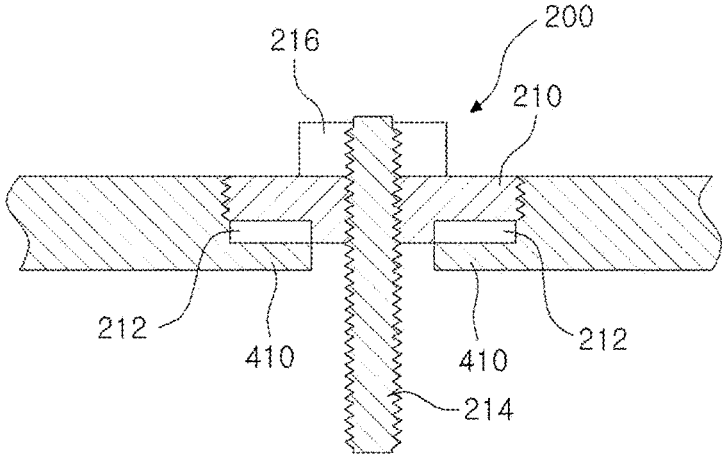
FIG. 6 is a cross-sectional view of a pressing member joined to a filter cover in a cavity filter according to an embodiment of the present invention.

FIG. 6 is a cross-sectional view of the pressing member joined to the filter cover in a cavity filter according to an embodiment of the present invention.

Referring to FIG. 6, the insertion part 210 of the pressing member 200 may be inserted in the insertion area 450, which may be formed due to the thickness difference between the filter's cover 400 and the thin-film portion 410. The pressing member 200 can be inserted in the insertion area 450 in the form of a screw joint. Using the thread formed in the inner perimeter of the insertion area 450 and the thread formed on the outer perimeter of the insertion part 210, the insertion part 210 may be inserted as it is rotated into the insertion area. The rotation of the insertion part 210 may continue until the insertion part 210 is completely resting on the insertion area 450.

A tuning bolt 214 may be inserted into the hole 420 formed in the insertion area 450. The tuning bolt 214 may be inserted through the hole 420 into the inside of the housing 100, where the tuning bolt 214 may be used to tune the properties of the filter. The tuning bolt 214 may be used for tuning the resonance frequency or bandwidth of the filter, where the resonance frequency or bandwidth of the filter may be tuned by adjusting the insertion depth of the tuning bolt 214.

When the desired filter properties are obtained from the tuning, the position of the tuning bolt 214 may be secured by using a nut 216 or the like.

When the insertion part 210 is inserted into the insertion area 450, the elastic member 212 joined to a lower portion of the insertion part 210 may press the thin-film portion 410 of the insertion area 450. Since the thin-film portion 410 has a thickness of such a degree that can be deformed in shape by pressure, the thin-film portion may be deformed downward according to the pressing by the elastic member 212.

An elastic member 212 made of silicone rubber or the like may provide an elastic force, making it possible to apply pressure on the thin-film portion 410 continuously.

Figure 7:
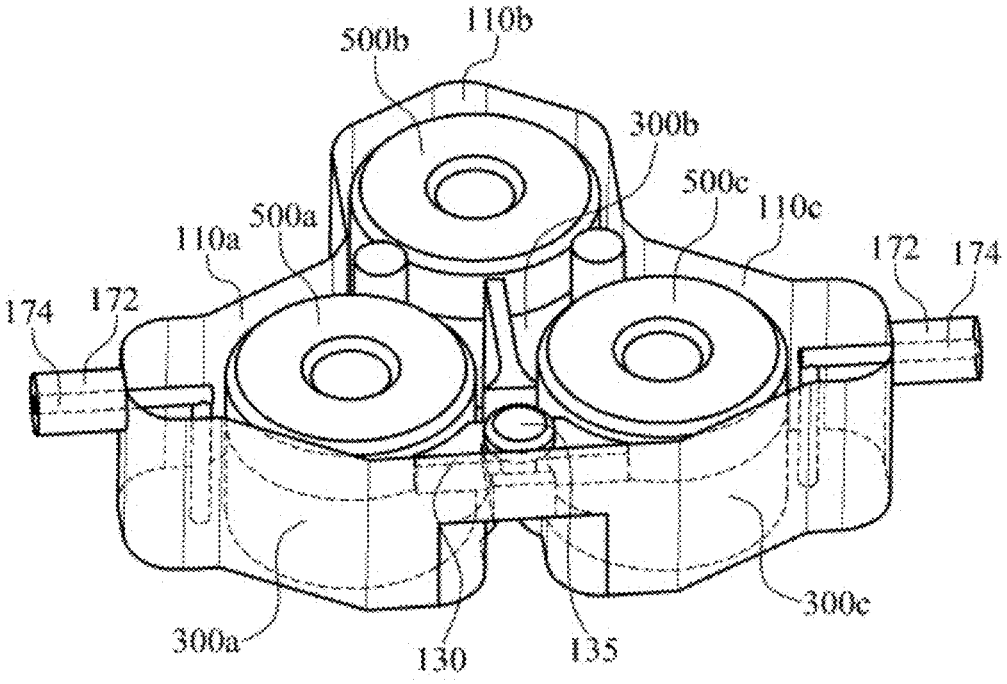
FIG. 7 is a perspective view conceptually illustrating only the resonator parts in a cavity filter according to an embodiment of the present invention.

FIG. 7 is a perspective view conceptually illustrating only the resonator parts in a cavity filter according to an embodiment of the present invention. That is, the housing 100 and the cover 400 are omitted, showing only the cavities 110 formed in the housing 100 and the components kept within the cavities 110.

A cavity filter according to an embodiment of the invention can include a multiple number of cavities 110*a*, 110*b*, 110*c* in the housing 100, and can include ceramic resonators 300*a*, 300*b*, 300*c* and ceramic rings 500*a*, 500*b*, 500*c* mounted in the respective cavities 110*a*, 110*b*, 110*c*. Each of the ceramic resonators 300*a*, 300*b*, 300*c* can include a resonator body 310 in which a through-hole 350 is formed, as well as a metal layer 370 formed on the inner perimeter of the through-hole 350 and on the surfaces of the one side and the other side of the resonator body 310, as described above.

In the cavity filter illustrated in FIG. 7, a window is formed between the first cavity 110*a* and the second cavity 110*b*, and a window is formed between the second cavity 110*b* and the third cavity 110*c*. In addition, between the first ceramic resonator 300*a* and the third ceramic resonator 300*c* that are positioned in the first cavity 110*a* and the third cavity 110*c*, which are not connected with each other, there is a coupling member 130 provided to implement a desired level of cross-coupling.

The coupling member 130 can be joined to the housing 100 and can be arranged such that its two ends are positioned near the first ceramic resonator 300*a* and the third ceramic resonator 300*c*, respectively. The coupling member 130 made from a metallic material can generate cross-coupling between the first ceramic resonator 300*a* and the third ceramic resonator 300*c*.

A separate space can be prepared in the housing 100 for mounting the coupling member 130, and the coupling member 130 can be held in this space.

The coupling member 130 can be used together with a particular adjustment bolt 135. The user can manipulate the adjustment bolt 135 to adjust the position of the coupling member 130 relative to the two resonators 300*a*, 300*c*. The adjustment bolt 135 can be configured to move the coupling member 130 along a predetermined direction when manipulated by the user or can be configured to simply secure or release the coupling member 130. By designing the adjustment bolt 135 such that it does not protrude over the top of the housing 100, it is possible to have the adjustment bolt 135 hidden by the cover 400.

When a signal is inputted through an input line 172, resonance may occur in the first resonator 300*a*, and due to a coupling with the second resonator 300*b* achieved through the window located between the first cavity 110*a* and the second cavity 110*b*, resonance may occur in the second resonator 300*b* as well. Similarly, the coupling between the second resonator 300*b* and the third resonator 300*c* achieved through the window between the second cavity 110*b* and the third cavity 110*c* allows resonance in the third resonator 300*c* also. Here, the coupling member 130 enables cross-coupling between the first resonator 300*a* and the third resonator 300*c*, and ultimately, the signal filtered by the resonance of the third resonator 300*c* may be outputted through an output line 174.

By using a ceramic ring and a ceramic resonator plated with a metal layer, a cavity filter according to an embodiment of the invention as set forth above can reduce the sizes of the resonators and cavities by up to 80% compared to a step impedance structure resonator based on the related art, and as such can provide a cavity filter suitable for small-scaled base stations.

While the present invention has been described above using particular examples, including specific elements, by way of limited embodiments and drawings, it is to be appreciated that these are provided merely to aid the overall understanding of the present invention, the present invention is not to be limited to the embodiments above, and various modifications and alterations can be made from the disclosures above by a person having ordinary skill in the technical field to which the present invention pertains. Therefore, the spirit of the present invention must not be limited to the embodiments described herein, and the scope of the present invention must be regarded as encompassing not only the claims set forth below, but also their equivalents and variations.

What is claimed is:

1. A cavity filter comprising:

a housing having at least one cavity formed therein, the housing having a ceramic resonator held in the at least one cavity;

a ceramic ring joined to an upper part of the ceramic resonator;

a cover joined to one side of the housing, and a pressing member joined to the cover, the pressing member configured to provide pressure to keep the ceramic ring in tight contact with the cover, wherein the ceramic resonator has a through-hole formed therein forming a penetration from one side to the other side along one direction, wherein a metal layer is formed on a surface of the one side of the ceramic resonator, on a surface of the other side of the ceramic resonator, and on an inner perimeter of the through-hole, wherein the metal layer is not formed on an outer perimeter of the ceramic resonator.

2. The cavity filter of claim 1, wherein the ceramic ring has an annular shape with a hole formed therein.

3. The cavity filter of claim 1, wherein the housing comprises a protrusion part on a surface of the cavity, the protrusion part protruding along the one direction, and the ceramic resonator is arranged in the cavity such that the protrusion part is inserted into the through-hole.

4. The cavity filter of claim 3, wherein an inner diameter at one side of the through-hole is larger than an inner diameter at the other side of the through-hole.

5. The cavity filter of claim 4, wherein the ceramic resonator is secured by way of a fastening part joined to the protrusion part, and an outer diameter of the fastening part is smaller than or equal to the inner diameter at the one side of the through-hole and larger than the inner diameter at the other side of the through-hole.

6. The cavity filter of claim 1, wherein the cover has an insertion area formed therein for inserting the pressing member, the insertion area has a thin-film portion formed therein, the thin-film portion having a smaller thickness compared to a main body of the cover, the pressing member is inserted in the insertion area to press the thin-film portion, and the ceramic ring contacts the thin-film portion.

7. The cavity filter of claim 6, further comprising:

a tuning bolt joined to the cover, wherein the tuning bolt is inserted inside the housing through the through-hole.

8. The cavity filter of claim 7, wherein the tuning bolt is configured such that an insertion depth thereof is adjustable and securable.

9. The cavity filter of claim 7, wherein a material of the tuning bolt comprises metal.

10. The cavity filter of claim 6, wherein a material of the pressing member comprises an elastic material.

11. The cavity filter of claim 1, wherein materials of the housing and the cover comprise metal.

12. The cavity filter of claim 1, wherein the housing has two or more cavities formed therein with each cavity having a ceramic resonator, the cavity filter further comprises a coupling member, wherein the coupling member is positioned near the two ceramic resonators held in the corresponding cavities, to generate cross-coupling between the two ceramic resonators.

13. The cavity filter of claim 12, further comprising:

an adjustment bolt configured to adjust a position of the coupling member relative to the two ceramic resonators.

14. The cavity filter of claim 12, wherein a window is formed between the cavities.

15. The cavity filter of claim 12, wherein a material of the coupling member comprises metal.

* * * * *